US009285152B2

(12) United States Patent
Fink et al.

(10) Patent No.: US 9,285,152 B2
(45) Date of Patent: Mar. 15, 2016

(54) METHOD FOR FREEZE PROTECTION

(75) Inventors: Ulrich Fink, Maple Grove, MN (US); Alan D. Gustafson, Eden Prairie, MN (US)

(73) Assignee: THERMO KING CORPORATION, Minneapolis, MN (US)

( * ) Notice: Subject to any disclaimer, the term of this patent is extended or adjusted under 35 U.S.C. 154(b) by 1030 days.

(21) Appl. No.: 12/693,509

(22) Filed: Jan. 26, 2010

(65) Prior Publication Data

US 2011/0180250 A1 Jul. 28, 2011

(51) Int. Cl.

| | |
|---|---|
| ***F25B 49/00*** | (2006.01) |
| ***F25D 21/02*** | (2006.01) |
| ***G05D 23/02*** | (2006.01) |
| ***F25B 29/00*** | (2006.01) |
| ***F25B 13/00*** | (2006.01) |
| ***F25D 21/04*** | (2006.01) |
| ***F25D 29/00*** | (2006.01) |

(52) U.S. Cl.

CPC ..... *F25D 21/04* (2013.01); *F25D 29/00* (2013.01); *F25B 2600/23* (2013.01); *F25B 2700/21174* (2013.01); *F25B 2700/21175* (2013.01); *F25D 2317/0651* (2013.01); *F25D 2317/0665* (2013.01)

(58) Field of Classification Search

CPC ..... F25D 21/04; F25B 2700/21174; F25B 2700/21175

USPC ..... 62/157, 158, 159, 160, 324.1, 127, 128

See application file for complete search history.

(56) References Cited

U.S. PATENT DOCUMENTS

| | | | | |
|---|---|---|---|---|
| 2,589,031 | A | | 3/1952 | Allyne |
| 4,313,308 | A | | 2/1982 | Boratgis et al. |
| 4,325,224 | A | * | 4/1982 | Howland ..... 62/196.2 |
| 4,509,586 | A | | 4/1985 | Watabe |
| 4,519,215 | A | * | 5/1985 | Barnett ..... 62/158 |
| 4,875,341 | A | | 10/1989 | Brandemuehl et al. |
| 4,903,502 | A | * | 2/1990 | Hanson et al. ..... 62/228.5 |
| 5,209,072 | A | * | 5/1993 | Truckenbrod et al. ..... 62/56 |

(Continued)

FOREIGN PATENT DOCUMENTS

| | | |
|---|---|---|
| EP | 0060724 | 9/1982 |
| EP | 0318420 | 5/1989 |

(Continued)

OTHER PUBLICATIONS

Extended European Search Report from the European Patent Office for Application No. 10251853.7 Mar. 27, 2012 (5 pages).

(Continued)

*Primary Examiner* — M. Alexandra Elve
*Assistant Examiner* — Daniel C Comings
(74) *Attorney, Agent, or Firm* — Hamre, Schumann, Mueller & Larson P.C.

(57) ABSTRACT

A method for freeze protection for a temperature control system, and a temperature control system for controlling the temperature of a temperature-controlled space at a set point temperature. The method includes monitoring a discharge air temperature, monitoring a return air temperature, setting a target temperature to equal the set point temperature, controlling the return air temperature at the target temperature, and adjusting the target temperature based on the return air temperature when the discharge air temperature drops to one of at or below freezing.

23 Claims, 4 Drawing Sheets

(56) References Cited

U.S. PATENT DOCUMENTS

| | | | | |
|---|---|---|---|---|
| 5,240,178 | A | 8/1993 | Dewolf et al. | |
| 5,415,346 | A | 5/1995 | Bishop | |
| 5,860,594 | A * | 1/1999 | Reason et al. | 62/209 |
| 5,909,370 | A | 6/1999 | Lynch | |
| 6,026,650 | A | 2/2000 | Beaverson et al. | |
| 6,027,031 | A | 2/2000 | Reason et al. | |
| 6,058,716 | A | 5/2000 | Reason et al. | |
| 6,619,061 | B2 | 9/2003 | Beaverson et al. | |
| 6,679,074 | B2 | 1/2004 | Hanson | |
| 7,080,521 | B2 * | 7/2006 | Ludwig et al. | 62/208 |
| 7,168,258 | B2 | 1/2007 | Al-Khateeb | |
| 7,266,961 | B2 | 9/2007 | Ludwig et al. | |
| 2003/0019224 | A1 * | 1/2003 | Vander Woude et al. | 62/186 |
| 2003/0024256 | A1 | 2/2003 | Hanson | |
| 2007/0144188 | A1 * | 6/2007 | Kaga et al. | 62/157 |
| 2009/0299534 | A1 | 12/2009 | Ludwig | |

FOREIGN PATENT DOCUMENTS

| | | |
|---|---|---|
| GB | 2098362 | 11/1982 |
| JP | 10205963 | 8/1998 |
| JP | 2001074355 | 3/2001 |
| JP | 2003090660 | 3/2003 |

OTHER PUBLICATIONS

European Office Action for European Application No. 10251853.7, dated Mar. 2, 2015, 5 pgs.

* cited by examiner

METHOD FOR FREEZE PROTECTION

BACKGROUND

The present invention relates to temperature control for a refrigerated space, such as a refrigerated trailer.

It is desirable for cargo in a refrigerated trailer to be kept at or near a set point temperature. Typically, discharge air from a refrigeration system entering the refrigerated trailer is colder than the set point temperature and can cause portions of cargo near the discharge air vent to freeze. It is desirable to prevent portions of the cargo from freezing, known as top freeze, when the set point temperature is set to be above freezing while maintaining the temperature of the cargo as close as possible to the set point. Current methods are either incapable of meeting both requirements or require complex fluid control systems and combined algorithms for temperature control, which interfere or even counteract each other and which require significant control software complexity.

SUMMARY

In one aspect, the invention provides a method for freeze protection for a temperature control system, the temperature control system for controlling the temperature of a temperature-controlled space at a set point temperature. The method includes monitoring a discharge air temperature, monitoring a return air temperature, setting a target temperature to equal the set point temperature, controlling the return air temperature at the target temperature, and adjusting the target temperature based on the return air temperature when the discharge air temperature drops to one of at or below freezing.

In another aspect, the invention provides a temperature control system for controlling the temperature of a temperature-controlled space at a set point temperature. The temperature control system includes a heat exchange assembly for heating the refrigerated space in a heat mode and cooling the refrigerated space in a cool mode, the heat exchange assembly positioned in communication with air in the refrigerated space by way of a return air flow path and a discharge air flow path. The temperature control system also includes a return air temperature sensor positioned in the return air flow path for sensing a return air temperature, a discharge air temperature sensor positioned in the discharge air flow path for sensing a discharge air temperature, and a controller for controlling the return air temperature to a target temperature. The controller is programmed to adjust the target temperature based on the return air temperature sensed by the return air temperature sensor when the discharge air temperature drops to one of at or below freezing.

In yet another aspect, the invention provides a method for freeze protection for a temperature control system, the temperature control system for controlling the temperature of a temperature-controlled space at a set point temperature. The method includes monitoring a discharge air temperature, monitoring a return air temperature, setting a target temperature to equal the set point temperature, controlling the return air temperature at the target temperature, and adjusting the target temperature based on the return air temperature when the discharge air temperature drops to one of at or below freezing. Controlling the return air temperature includes cooling the refrigerated space in a cool mode and heating the refrigerated space in a heat mode. Adjusting the target temperature includes setting a timer to count the duration of the cool mode, lowering the target temperature when the timer reaches a predetermined time, incrementing a transition counter when the temperature control system switches between the cool mode and the heat mode and lowering the target temperature when the transition counter reaches a predetermined count.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
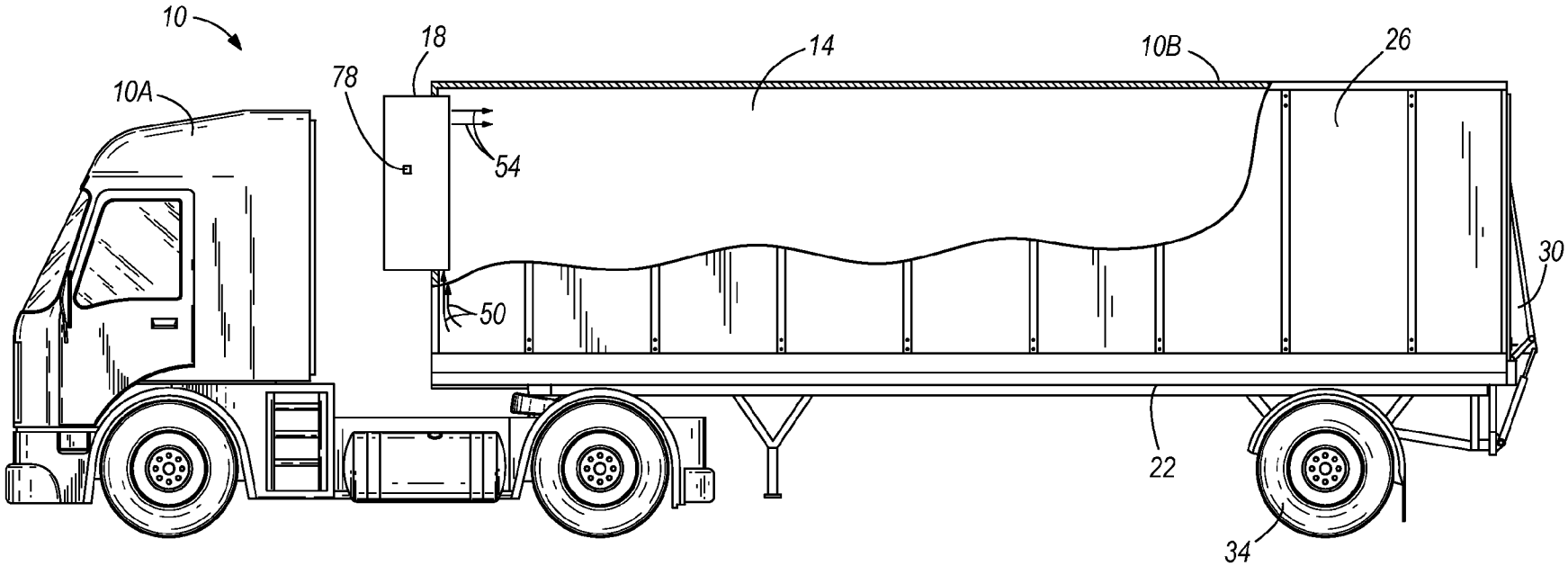
FIG. 1 is a side view of a vehicle including a trailer having a temperature control system according to the present invention.

FIG. 1 illustrates a vehicle 10, in particular a tractor 10A and a trailer 10B defining a cargo or load space 14, having a temperature control system 18 according to the present invention. In other constructions, the vehicle 10 can be a straight truck, van or the like having an integral cargo portion, which is not readily separable from an associated driving portion. In yet other constructions, the temperature control system 18 is not limited to a transport temperature control application and may be applied to stationary temperature control systems.

As shown in FIG. 1, the trailer 10B includes a frame 22 and an outer wall 26 supported on the frame 22 and substantially enclosing the load space 14. Doors 30 are supported on the frame 22 for providing access to the load space 14. In some embodiments, the load space 14 can include a partition or an internal wall for at least partially dividing the load space 14 into sub-compartments, which can be maintained at a different set point temperature. A plurality of wheels 34 are provided on the frame 22 to permit movement of the vehicle 10 across the ground.

Figure 2:
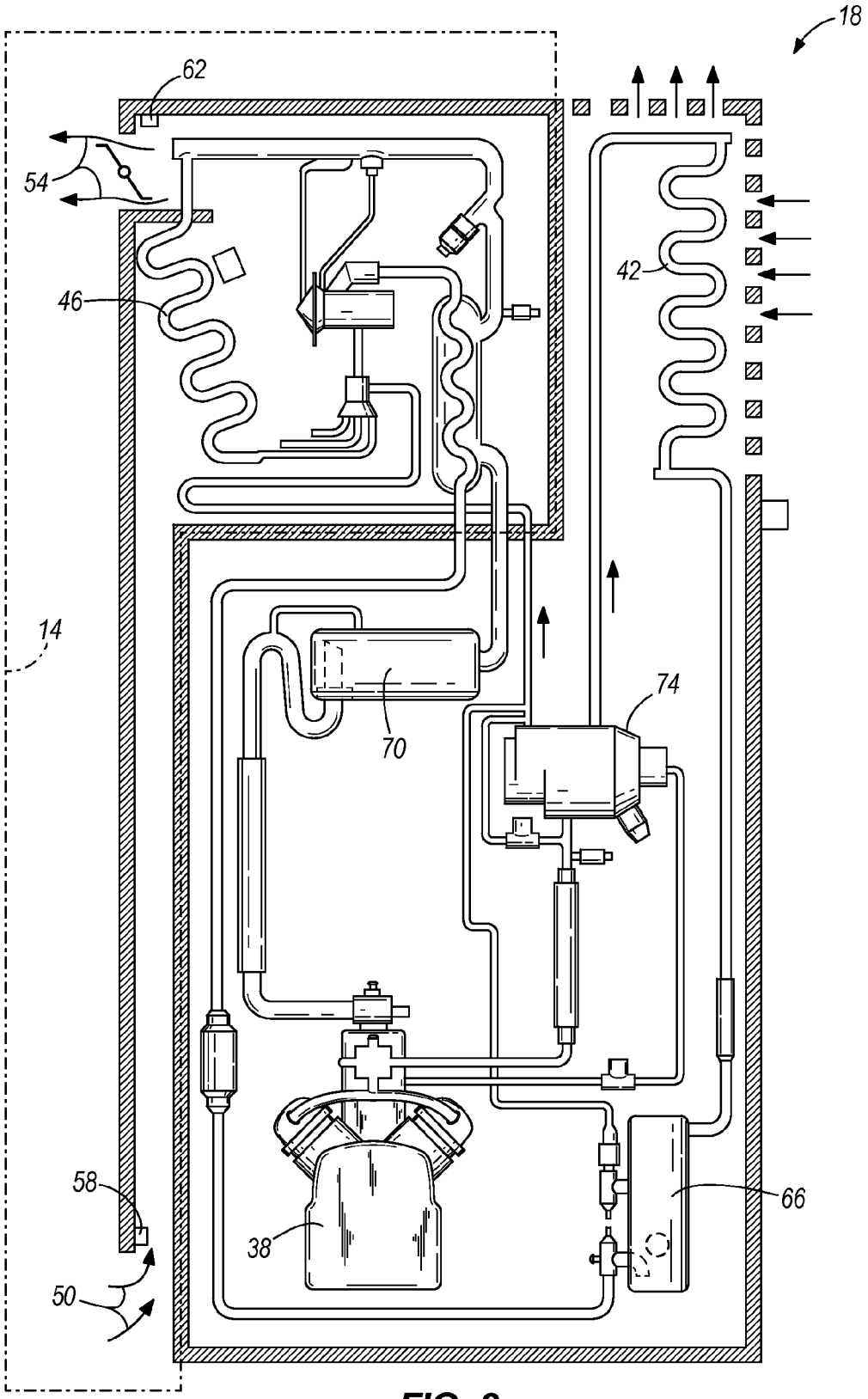
FIG. 2 is a schematic diagram of the temperature control system of FIG. 1.

As illustrated in FIG. 2, the temperature control system 18, such as a vapor compression system, includes a compressor 38, first heat exchanger 42 and second heat exchanger 46 fluidly connected for circulating a heat transfer fluid. The temperature control system 18 is controlled by a controller 78 (FIG. 1) in accordance with the present invention. Other components include a receiver 66, an accumulator 70, a three-way valve 74 for switching the temperature control system 18 between a cooling mode and a heating mode, and fans for circulating air in a manner well understood by those having ordinary skill in the art. The other components of the temperature control system 18 will not be described in great detail as many variations known to those having ordinary skill in the art may be employed. In other embodiments, the temperature control system 18 can be used with shipping containers, rail cars, or other transported cargo spaces.

With reference to FIG. 2, the second heat exchanger 46 is in fluid communication with air inside the cargo space 14 to cool the cargo space in the cooling mode and to heat the cargo space 14 in the heating mode to maintain the cargo space 14 at or near a set point temperature. As shown in FIGS. 1 and 2, return air 50 from the cargo space 14 enters the temperature control system 18 and discharge air 54 exits the temperature control system 18 and is discharged to the cargo space 14. A return air temperature sensor 58 is positioned in the return air flow 50 to measure the temperature of the return air 50. A discharge air temperature sensor 62 is positioned in the discharge air flow 54 to measure the temperature of the discharge air 54.

Figure 3A:
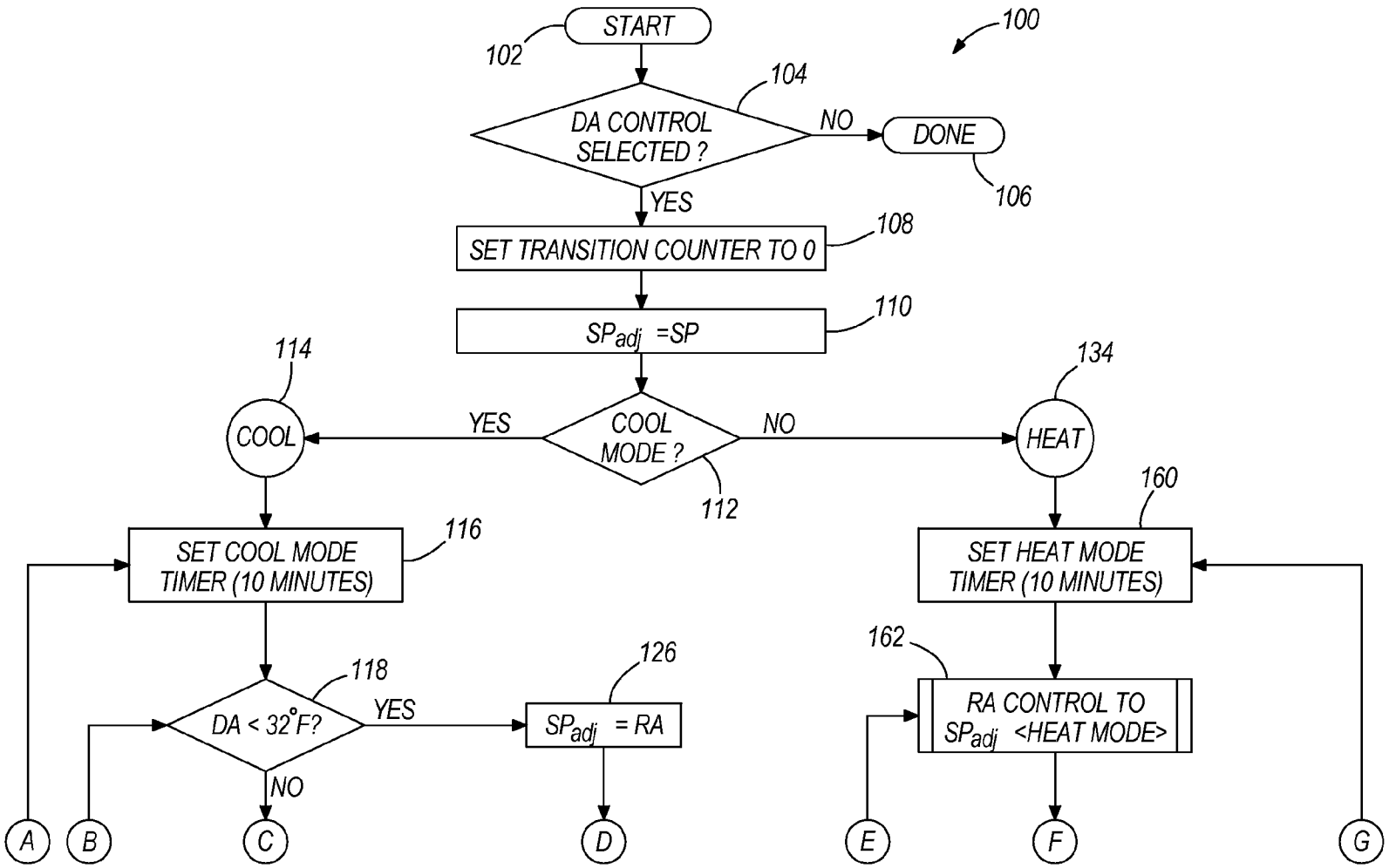
FIGS. 3A-3B are a flow chart for an algorithm in the form of a computer program that can be used to practice a method for freeze protection for the temperature control system of FIG. 1.
Figure 3B:
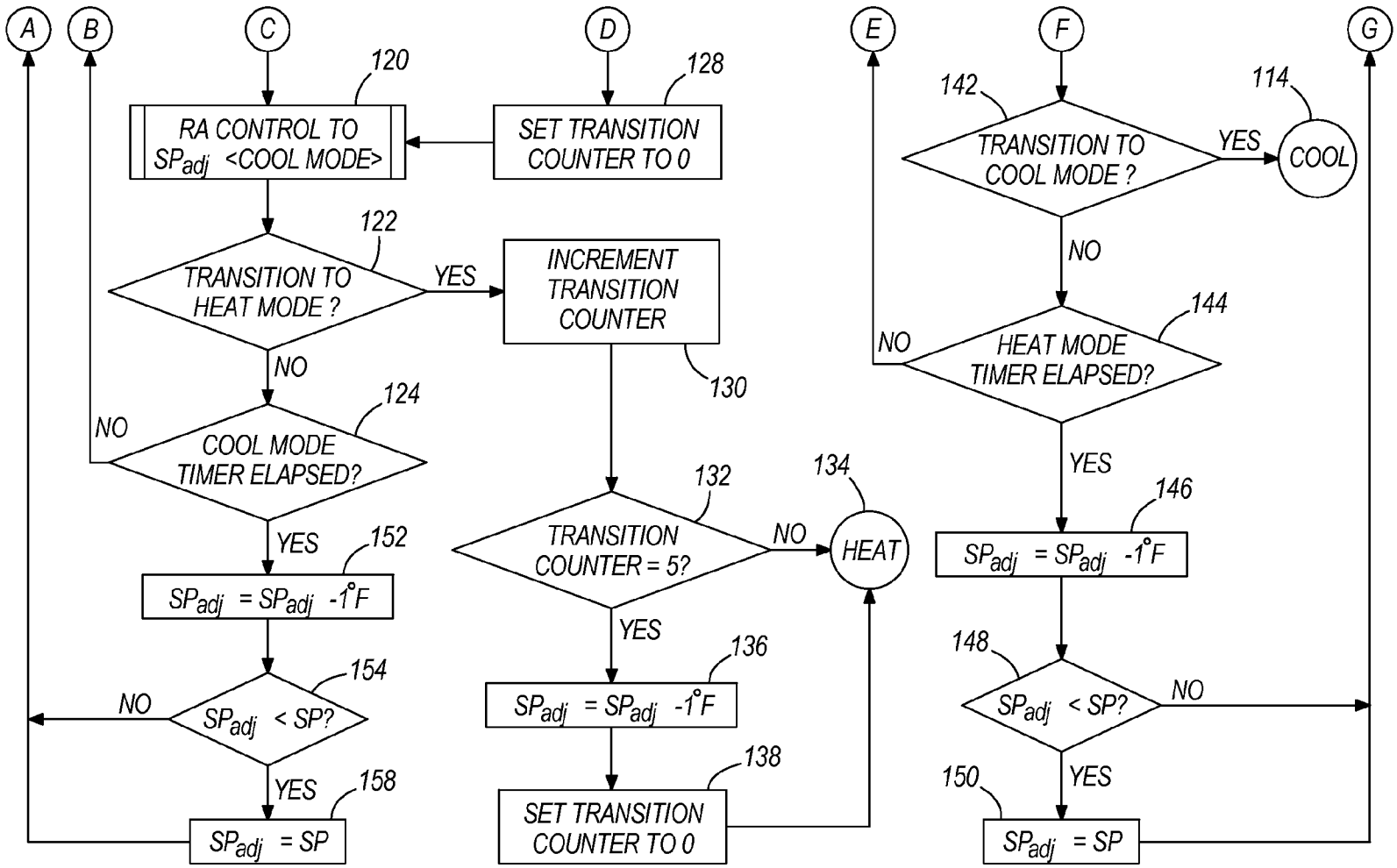

FIGS. 3A-3B illustrate an algorithm 100, or program, for the controller 78 in the form of a computer program. The algorithm 100 is illustrated on two pages, and letters A-G are used as guides to link between FIG. 3A and FIG. 3B. The algorithm 100 controls a temperature of the return air 50 to be at or near a user selectable set point temperature (SP) and controls the discharge air temperature to prevent top freeze. Referring to FIG. 3A, the program begins at block 102. After block 102, the program proceeds to block 104 where the program determines whether discharge air (DA) control is selected. Discharge air control prevents top freeze by controlling the discharge air temperature, as will be described below. Discharge air control applies only to fresh loads, e.g., set point temperatures equal to or greater than 32 degrees Fahrenheit. If discharge air control is not selected (NO at block 104), e.g., the set point temperature is set below 32 degrees Fahrenheit, the program proceeds to block 106 and is finished. If discharge air control is selected (YES at block 104), e.g., the set point temperature is in the fresh range, the program proceeds to block 108.

At block 108, the program sets a transition counter to zero. Then, the program proceeds to block 110. At block 110, the program sets a target set point ($SP_{adj}$) to equal the user-selected set point temperature. Then, the program proceeds to block 112. At block 112, the program determines whether the temperature control system 18 requires the cooling mode. The cooling mode operates to cool the cargo space 14 such that the return air 50 is controlled to the target set point temperature. For example, if the return air temperature is greater than the target set point temperature, then the temperature control system 18 requires the cooling mode. In some constructions, the fans can be actuated prior to measuring return air temperature. If the temperature control system 18 requires the cooling mode (YES at block 112), the program proceeds to block 114. At block 114, the cooling mode is operated to control the return air temperature to the target set point temperature. The cooling mode continues until the temperature control system 18 transitions to the heating mode or the temperature control system 18 is shut down. If the temperature control system 18 does not require the cooling mode (NO at block 112), the program proceeds to block 134. Block 134 is the heating mode, which will be described in greater detail below.

In the cooling mode at block 114, the program proceeds to block 116. At block 116, the program sets a cool mode timer to a predetermined time, for example, to ten minutes. The cool mode timer is a variable timer and can be set to other amounts of time greater than or less than ten minutes. Then, the program proceeds to block 118. At block 118, the program determines whether the discharge air temperature is below 32 degrees Fahrenheit. In other constructions, the program can determine whether the discharge air temperature is at or below 32 degrees Fahrenheit. If the discharge air temperature is not below 32 degrees Fahrenheit (NO at block 118), then the program proceeds to block 120 (FIG. 3B). At block 120, the program controls the return air temperature to the target set point. Then, the program proceeds to block 122. At block 122, the program determines whether it is necessary to transition to the heating mode. For example, if the measured return air temperature is at or below the target set point temperature, then it is necessary to transition to the heating mode. If the heating mode is not required (NO at block 122), then the program proceeds to block 124. At block 124, the program determines whether the cool mode timer has elapsed. If the cool mode timer has not elapsed, the program returns to block 118 (FIG. 3A). If the program determines that the cool mode timer has elapsed (YES at block 124), then the program proceeds to block 152.

At block 152, the program lowers the target set point temperature by one degree. Then, the program proceeds to block 154. At block 154, the program determines whether the target set point is less than the user-selected set point. If the target set point is not less than the user-selected set point (NO at block 154), then the program returns to block 116 (FIG. 3A). If the target set point is less than the user-selected set point (YES at block 154), then the program proceeds to block 158. At block 158, the program sets the target set point equal to the user-selected set point. Then, the program returns to block 116 (FIG. 3A). At block 116, the cool mode timer is set to the predetermined time, as described above. Then, the program proceeds to block 118.

At block 118, if the discharge air temperature is below 32 degrees Fahrenheit (YES at block 118), then the program proceeds to block 126. At block 126, the return air temperature is measured and the target set point temperature is adjusted to equal the return air temperature. This action prevents the discharge air from causing top freeze. Then, the program proceeds to block 128 (FIG. 3B). At block 128, a transition counter is set to zero. The transition counter counts the number of times the temperature control system 18 transitions from the cooling mode to the heating mode. Then, the program proceeds to block 120. At block 120, the program controls the return air temperature to the target set point, as described above. Then, the program proceeds to block 122. At block 122, the program determines whether it is necessary to transition to the heating mode, as described above.

If it is necessary to transition to the heating mode (YES at block 122), then the program proceeds to block 130. At block 130, the transition counter is incremented by one count. Then, the program proceeds to block 132. At block 132, the program determines whether the transition counter is equal to a predetermined amount, such as five. The transition counter is a variable counter such that, in other constructions, the algorithm 100 can be programmed to determine whether the transition counter is equal to a value less than or greater than five at block 132. If the transition counter is not equal to the predetermined amount (NO at block 132), then the program proceeds to block 134, which is the heating mode. If the transition counter is equal to the predetermined amount at block 132 (YES at block 132), then the program proceeds to block 136. At block 136, the program lowers the target set point temperature by one degree. Then, the program proceeds to block 138. At block 138, the program sets the transition counter to zero. Then, the program moves to block 134, to the heating mode.

At block 134, the heating mode is operated to control the return air temperature to the target set point temperature. The heating mode continues until the temperature control system 18 transitions to the cooling mode or the temperature control system 18 is shut down. At block 134, the program proceeds to block 160. At block 160, the program sets a heat mode timer to a predetermined time, for example, to ten minutes. The heat mode timer is a variable timer and can be set to other amounts of time greater than or less than ten minutes. Then, the program proceeds to block 162. At block 162, the return air temperature is controlled to the target set point. Then, the program proceeds to block 142. At block 142, the program determines whether it is necessary to transition to the cooling mode. For example, if the return air temperature is greater than the target set point temperature, then it is necessary to transition to the cooling mode. If it is necessary to transition to the cooling mode (YES at block 142), then the program proceeds to block 114 and enters or returns to the cooling mode. In alternate constructions, the transition counter may alternatively or additionally be incremented when transitioning from heating to cool mode (YES at block 142). If it is not necessary to transition to the cooling mode (NO at block 142), then the program proceeds to block 144. At block 144, the program determines whether the heat mode timer has elapsed. If the heat mode timer has not elapsed (NO at block 144), then the program returns to block 162, and continues in heating mode. If the heat mode timer has elapsed (YES at block 144), then the program proceeds to block 146. At block 146, the target set point temperature is lowered by one degree. Then, the program proceeds to block 148. At block 148, the program determines whether the target set point temperature is less than the user-selected set point temperature. If the target set point temperature is not less than the user-selected set point temperature (NO at block 148), then the program returns to block 160. If the target set point temperature is less than the user-selected set point temperature (YES at block 148), then the program proceeds to block 150. At block 150, the program sets the target set point temperature equal to the user-selected set point temperature. Then, the program returns to block 160.

In operation, the controller 78 monitors the return air temperature and the discharge air temperature. In the cooling mode, the return air temperature, which is indicative of a temperature of the cargo in the cargo space 14, is controlled to the target set point temperature. Initially, the target set point temperature is set to equal the user-selected set point temperature. However, in order to prevent top freeze, the target set point temperature is adjusted when the discharge air drops below freezing. Specifically, the target set point is adjusted to equal the return air temperature (at block 126) when the discharge air temperature drops below freezing. This adjustment is continuous, as illustrated in FIGS. 3A-3B, and prevents top freeze by preventing the discharge air temperature from getting too cold. As return air is typically warmer than discharge air in the cooling mode, the target set point temperature is adjusted to be higher than the user-selected set point temperature. When the target set point is adjusted to equal the return air temperature (at block 126), the temperature control system 18 will typically transition to a heat mode (at block 122) because the measured return air temperature is suddenly equal to the new target set point, i.e., the return air temperature is not greater than the target temperature.

As it is desirable to control the return air to be as close as possible to the user-selected set point temperature, the control algorithm 100 determines when it is appropriate to lower the target set point such that the target set point is moved closer to the user-selected set point, while still preventing top freeze. First, the program counts the number of times the temperature control system 18 transitions from the cooling mode to the heating mode. If the temperature control system 18 transitions a predetermined number of times, such as five, without the discharge air temperature dropping below freezing, then it is likely that the target set point can be lowered closer to the user-selected set point without the discharge air causing top freeze. Thus, the target set point is lowered by one degree. Second, the program counts the period of time during which the temperature control system 18 remains in the cooling mode or the heating mode. If the temperature control system 18 remains in the cooling mode for a predetermined period of time, or in the heating mode for a predetermined period of time, such as ten minutes, then it is likely that the target set point can be lowered closer to the user-selected set point without the discharge air causing top freeze. Thus, the target set point is lowered by one degree. If the target set point temperature has been lowered (at block 146 or 152) to be below the user-selected set point temperature, then the program sets the target set point temperature equal to the user-selected set point temperature (at blocks 148 and 150 and at blocks 154 and 158). This prevents the target set point from being lower than the user-selected set point.

In other constructions, the discharge air can be monitored to determine when the target set point can be lowered closer to the user-selected set point. When the discharge air temperature rises to a predetermined value, such as 35 degrees, the target set point can be lowered by, for example, one degree.

Thus, the invention provides, among other things, temperature control system providing a method and apparatus for freeze protection. Various features and advantages of the invention are set forth in the following claims.

What is claimed is:

1. A method for freeze protection for a temperature control system, the temperature control system for controlling the temperature of a temperature-controlled space at a user-selected set point temperature, the method comprising:

monitoring a discharge air temperature;

monitoring a return air temperature;

with a controller, setting a return air target temperature to equal the user-selected set point temperature;

controlling the return air temperature to be approximately equal to the return air target temperature; and adjusting the return air target temperature when the discharge air temperature drops to one of at or below freezing, wherein the controller determines an adjusted value for the return air target temperature during the adjusting step that is dependent on a measured value of the return air temperature.

2. The method of claim 1, wherein controlling the return air temperature includes cooling the refrigerated space in a cool mode and heating the refrigerated space in a heat mode, the method further comprising:

setting a timer to count the duration of the cool mode; and lowering the return air target temperature when the timer reaches a predetermined time.

3. The method of claim 2, further comprising lowering the return air target temperature by one degree Fahrenheit when the timer reaches ten minutes.

4. The method of claim 2, wherein lowering the return air target temperature includes lowering the return air target temperature when the timer reaches the predetermined time without the discharge air temperature dropping to one of at or below freezing.

5. The method of claim 2, further comprising incrementing a transition counter when the temperature control system switches between the cool mode and the heat mode.

6. The method of claim 5, further comprising lowering the return air target temperature when the transition counter reaches a predetermined count.

7. The method of claim 6, further comprising lowering the return air target temperature by one degree Fahrenheit when the transition counter equals 5.

8. The method of claim 6, wherein the timer is a first timer and the predetermined time is a first predetermined time, the method further comprising:

setting a second timer to count the duration of the heat mode; and lowering the return air target temperature when the second timer reaches a second predetermined time.

9. The method of claim 8, further comprising lowering the set point target temperature by one degree Fahrenheit when the second timer reaches ten minutes.

10. The method of claim 2, wherein the timer is a first timer and the predetermined time is a first predetermined time, the method further comprising:

setting a second timer to count the duration of the heat mode; and lowering the return air target temperature when the second timer reaches a second predetermined time.

11. The method of claim 1, wherein controlling the return air temperature includes cooling the refrigerated space in a cool mode and heating the refrigerated space in a heat mode, the method further comprising:

incrementing a transition counter when the temperature control system switches between the cool mode and the heat mode.

12. The method of claim 11, further comprising lowering the return air target temperature by one degree Fahrenheit when the transition counter equals 5.

13. The method of claim 1, further comprising determining whether the set point temperature is in a fresh temperature range.

14. A temperature control system for controlling the temperature of a temperature-controlled space at a user-selected set point temperature, the temperature control system comprising:

a heat exchange assembly for heating the refrigerated space in a heat mode and cooling the refrigerated space in a cool mode, the heat exchange assembly positioned in communication with air in the refrigerated space by way of a return air flow path and a discharge air flow path;

a return air temperature sensor positioned in the return air flow path for sensing a return air temperature;

a discharge air temperature sensor positioned in the discharge air flow path for sensing a discharge air temperature;

a controller for controlling the return air temperature to be approximately equal to a return air target temperature wherein the return air target temperature is initially set to equal the user-selected set point temperature, the controller being programmed to adjust the return air target temperature when the discharge air temperature drops to one of at or below freezing, wherein the controller is programmed to determine an adjusted value for the return air target temperature that is dependent on a measured value of the return air temperature sensed by the return air temperature sensor.

15. The temperature control system of claim 14, further comprising a cool mode timer for counting the duration of the cool mode, wherein the controller is programmed to lower the return air target temperature when the timer reaches a predetermined time without the discharge air dropping to one of at or below freezing.

16. The temperature control system of claim 15, wherein the controller is programmed to lower the return air target temperature by one degree Fahrenheit when the timer reaches ten minutes.

17. The temperature control system of claim 15, further comprising a transition counter for counting the number of times the temperature control system switches between the cool mode and the heat mode, wherein the controller is programmed to lower the return air target temperature when the transition counter reaches a predetermined count without the discharge air dropping to one of at or below freezing.

18. The temperature control system of claim 17, wherein the controller is programmed to lower the return air target temperature by one degree Fahrenheit when the transition counter equals 5.

19. The temperature control system of claim 17, further comprising a heat mode timer for counting a duration of the heat mode, wherein the controller is programmed to lower the return air target temperature when the heat mode timer reaches a predetermined time without the discharge air dropping to one of at or below freezing.

20. The temperature control system of claim 19, wherein the controller is programmed to lower the return air target temperature by one degree when the heat mode timer reaches ten minutes.

21. The temperature control system of claim 14, further comprising a heat mode timer for counting a duration of the heat mode, wherein the controller is programmed to lower the return air target temperature when the heat mode timer reaches a predetermined time without the discharge air dropping to one of at or below freezing.

22. The temperature control system of claim 14, further comprising a transition counter for counting the number of times the temperature control system switches between the cool mode and the heat mode, wherein the controller is programmed to lower the return air target temperature when the transition counter reaches a predetermined count without the discharge air dropping to one of at or below freezing.

23. A method for freeze protection for a temperature control system, the temperature control system for controlling the temperature of a temperature-controlled space at a set point temperature, the method comprising:

monitoring a discharge air temperature;

monitoring a return air temperature;

setting a target temperature to equal the set point temperature;

controlling the return air temperature at the target temperature, including cooling the refrigerated space in a cool mode, and heating the refrigerated space in a heat mode; and adjusting the target temperature based on the return air temperature when the discharge air temperature drops to one of at or below freezing, including setting a timer to count the duration of the cool mode and lowering the target temperature when the timer reaches a predetermined time, and incrementing a transition counter when the temperature control system switches between the cool mode and the heat mode and lowering the target temperature when the transition counter reaches a predetermined count.

* * * * *